US008242996B2

(12) United States Patent
Lee

(10) Patent No.: US 8,242,996 B2
(45) Date of Patent: Aug. 14, 2012

(54) DISPLAY DEVICE WITH STORAGE ELECTRODE DRIVER TO SUPPLY A BOOSTING AND SUSTAINING VOLTAGE

(75) Inventor: Baek-Woon Lee, Yongin-si (KR)

(73) Assignee: Samsung Electronics Co., Ltd. (KR)

( * ) Notice: Subject to any disclaimer, the term of this patent is extended or adjusted under 35 U.S.C. 154(b) by 763 days.

(21) Appl. No.: 11/752,578

(22) Filed: May 23, 2007

(65) Prior Publication Data

US 2007/0273630 A1 Nov. 29, 2007

(30) Foreign Application Priority Data

May 23, 2006 (KR) ..... 10-2006-0046028

(51) Int. Cl.
*G09G 3/36* (2006.01)

(52) U.S. Cl. ..... 345/92; 345/100

(58) Field of Classification Search ..... 345/92, 345/96, 100, 209
See application file for complete search history.

(56) References Cited

U.S. PATENT DOCUMENTS

| | | | | |
|---|---|---|---|---|
| 5,686,932 | A * | 11/1997 | Tomita | 345/94 |
| 7,230,597 | B2 * | 6/2007 | Edwards et al. | 345/87 |
| 2002/0084969 | A1 | 7/2002 | Ozawa | |
| 2005/0035938 | A1 | 2/2005 | Noda | |
| 2005/0110734 | A1 * | 5/2005 | Hirosawa | 345/87 |
| 2006/0001630 | A1 * | 1/2006 | Chen et al. | 345/96 |
| 2006/0061540 | A1 * | 3/2006 | Harada | 345/103 |
| 2006/0145985 | A1 * | 7/2006 | Hwang et al. | 345/92 |
| 2006/0176255 | A1 * | 8/2006 | Do et al. | 345/87 |
| 2006/0243977 | A1 * | 11/2006 | Yamasaki | 257/59 |
| 2006/0284811 | A1 * | 12/2006 | Huang | 345/92 |
| 2007/0195049 | A1 * | 8/2007 | Choi et al. | 345/98 |

FOREIGN PATENT DOCUMENTS

| | | |
|---|---|---|
| EP | 1536408 A2 | 6/2005 |
| JP | 02291520 | 12/1990 |
| JP | 05107557 | 4/1993 |
| JP | 10062748 | 3/1998 |
| JP | 2005017484 | 1/2005 |
| JP | 2005316369 | 11/2005 |
| JP | 2006047993 | 2/2006 |
| JP | 2006072211 | 3/2006 |
| JP | 2006113359 | 4/2006 |

OTHER PUBLICATIONS

European Search Report; EP07010122; Aug. 24, 2007.

* cited by examiner

*Primary Examiner* — Chanh Nguyen
*Assistant Examiner* — Kwang-Su Yang
(74) *Attorney, Agent, or Firm* — Cantor Colburn LLP

(57) ABSTRACT

A display device includes a plurality of gate lines transmitting gate signals wherein each gate signal has a gate-on voltage and a gate-off voltage, a plurality of data lines intersecting the gate lines and transmitting data voltages, a plurality of storage electrode lines extending in parallel to the gate lines and transmitting storage signals, a plurality of pixels arranged in a matrix wherein each pixel includes a switching element connected to a gate line and a data line, a liquid crystal capacitor connected to the switching element and a common voltage, a storage capacitor connected to the switching element and a storage electrode line, and a plurality of storage signal generators generating the storage signals based on the gate signals. The storage signal applied to each pixel has a changed voltage level immediately after the charging the data voltage into the liquid crystal capacitor and the storage capacitor is completed.

21 Claims, 8 Drawing Sheets

DISPLAY DEVICE WITH STORAGE ELECTRODE DRIVER TO SUPPLY A BOOSTING AND SUSTAINING VOLTAGE

This application claims priority to Korean Patent Application No. 10-2006-0046028 filed on May 23, 2006, and all the benefits accruing therefrom under 35 U.S.C. 119, the contents of which in its entirety are herein incorporated by reference.

BACKGROUND OF THE INVENTION (a) Field of the Invention

The present invention relates to a display device.

(b) Description of the Related Art

In general, a liquid crystal display includes two display panels having pixel electrodes, a common electrode, and a liquid crystal layer having dielectric anisotropy between the panels. The pixel electrodes are arranged in a matrix and connected to switching devices such as thin film transistors (TFTs) which sequentially apply data voltages to the pixels. The common electrode is disposed over the entire surface of the display panel and supplied with a common voltage. The pixel electrode, the common electrode, and the liquid crystal layer constitute a liquid crystal capacitor. The liquid crystal capacitor together with the switching element is a pixel unit.

The image data voltages vary the strength of the electric field applied to the liquid crystal layer between the two panels thereby controlling the transmittance of light passing through the liquid crystal layer to display images corresponding to the data voltages. To prevent the degradation of the liquid crystal, the polarities of the data voltages with respect to the common voltage are inverted for each frame, pixel row, or pixel.

However, since the response speed of the liquid crystal molecules is low, it takes time for a voltage (hereinafter referred to as a pixel voltage) charged in the liquid crystal capacitor to reach the target voltage. The target voltage is the voltage that effects a desired luminance. The time depends on the difference between the target voltage and the voltage previously charged on the liquid crystal capacitor. Therefore, when the difference between the target voltage and the previously-charged voltage is large, application of only the target voltage will not be enough to cause the pixel voltage to reach the target voltage during the time when the switching element is turned on.

In order to solve the problem, a DCC (dynamic capacitance compensation) scheme has been proposed. The DCC scheme employs the fact that charging speed is proportional to the voltage across the liquid crystal capacitor. The data voltage (actually the difference between the data voltage and the common voltage, usually assumed to be 0V), applied to the pixel is chosen to be higher than the target voltage so as to shorten the time taken for the pixel voltage to reach the target voltage. However, in the DCC scheme, frame memories and driving circuits for performing DCC calculation are needed. Therefore, there are difficult problems in circuit design and increased production cost.

To reduce power consumption in display devices of medium or small size, such as mobile phones, row inversion is performed. However, as the resolution of medium or small size display devices increases, so does power consumption. In particular, when the DCC calculation is performed, power consumption is greatly increased due to the additional calculations and circuitry.

The range of data voltage available for image display using row inversion is small in comparison with dot inversion where the polarities of the data voltages are inverted for each pixel. Therefore, in a VA (vertical alignment) mode liquid crystal display, if the threshold voltage for driving the liquid crystal is high, the available range of the data voltage to represent grayscales for image display is reduced by the amount of the threshold voltage. Therefore, the desired luminance cannot be obtained.

BRIEF SUMMARY OF THE INVENTION

In accordance with an aspect of the present invention a display device offers improved response speed and image quality without increasing power consumption. According to an embodiment of the present invention, a display device comprises a pixel electrode, a data driver generating a data voltage, a gate driver generating a gate voltage, a pixel switching device being turned on and off according to the gate voltage, and supplying the data voltage to the pixel electrode when being turned on, a storage capacitor comprising a part of the pixel electrode, a storage electrode and a insulator therebetween, and a storage electrode driver supplying a boosting voltage to the storage electrode for at least two durations while the pixel switching device is turned off.

The storage electrode driver supplies a sustaining voltage while the pixel switching device is turned on.

The data voltage may be selected from one of a first data voltage group and second data voltage group. In this case, a voltage of the pixel electrode is higher than the common voltage when the data voltage is selected from the first data voltage group, and the voltage of the pixel electrode is lower than the common voltage when the data voltage is selected from the second data voltage group, and the boosting voltage is higher than the sustaining voltage when the data voltage is selected from the first group, and the boosting voltage is lower than the sustaining voltage when the data voltage is selected from the second group.

The storage electrode driver may include a voltage source.

The storage electrode driver may include a stage comprising a first switching element comprising an output terminal connected to the storage electrode, an input terminal connected to the voltage source and a control terminal connected to a first control signal source; a second switching element comprising an output terminal connected to the storage electrode, an input terminal connected to the voltage source and a control terminal connected to a second control signal source; and a third switching element comprising an output terminal connected to the storage electrode, an input terminal connected to the voltage source and a control terminal connected to a third control signal source.

The display apparatus may further include a plurality of gate line connected to the gate driver, and a $i^{th}$ gate line of the plurality of gate line is connected to the switching device and the gate driver. The gate driver supplies each of the plurality of gate line with a turn-on voltage pulse subsequentially line by line. The rising edges of two turn-on pulses supplied two neighboring gate lines respectively which are separated with a term. The voltage source may generate a storage electrode voltage alternating between a first level and a second level higher than the first level at alternating cycles. The alternating cycle may be twice a term. In this case, the first control signal source may be the $i^{th}$ gate line, the second control signal source may be a $(i+2K+1)^{th}$ gate line and the third control signal source may be the $(i+2N+1)^{th}$ gate line. Herein the K is a natural number or 0 and the N is a natural number larger than K.

The display apparatus may further include 2N+1 additional gate lines.

Otherwise, the voltage source may further include a first voltage source generating a first storage electrode voltage alternating between a first level and a second level higher than the first level at an alternating cycle, and a second voltage source generating a second storage electrode voltage having a phase opposite to a phase of the first storage electrode voltage.

In this case, the input terminal of the first switching device is connected to one of the first and second voltage sources and the input terminal of the first switching device are connected to the other of the first and second voltage sources, and the alternating cycle may be twice a frame. The first control signal source is the $i^{th}$ gate line, the second control signal source is a $(i+K+1)^{th}$ gate line and the third control signal source is the $(i+N+1)^{th}$ gate line. Herein K is a natural number or 0, and N is a natural number larger than K. The display apparatus may further comprise N+1 additional gate lines.

The data voltage may be selected from the first and second data voltage group alternatively frame by frame.

The display apparatus may further comprise a storage electrode line of which one end is connected to the output terminals of the first to third switching elements commonly and the other end is connected to the storage electrode and further includes a capacitance maintaining a voltage of the storage electrode.

This capacitance may include a first capacitance comprising a part of the storage electrode line, a first electrode and a first insulating layer between the part of the storage electrode line and the first electrode and a second capacitance having the part of the storage electrode line, a second electrode and a second insulating layer between the part of the storage electrode line and the second electrode.

The part of the storage electrode line may be interposed between the first and second insulator and the first and the second electrode may be electrically connected to each other.

BRIEF DESCRIPTION OF THE DRAWINGS

An exemplary embodiment of the present invention will be described in detail with reference to the accompanying drawing, in which.

DETAILED DESCRIPTION OF THE INVENTION

Figure 1:
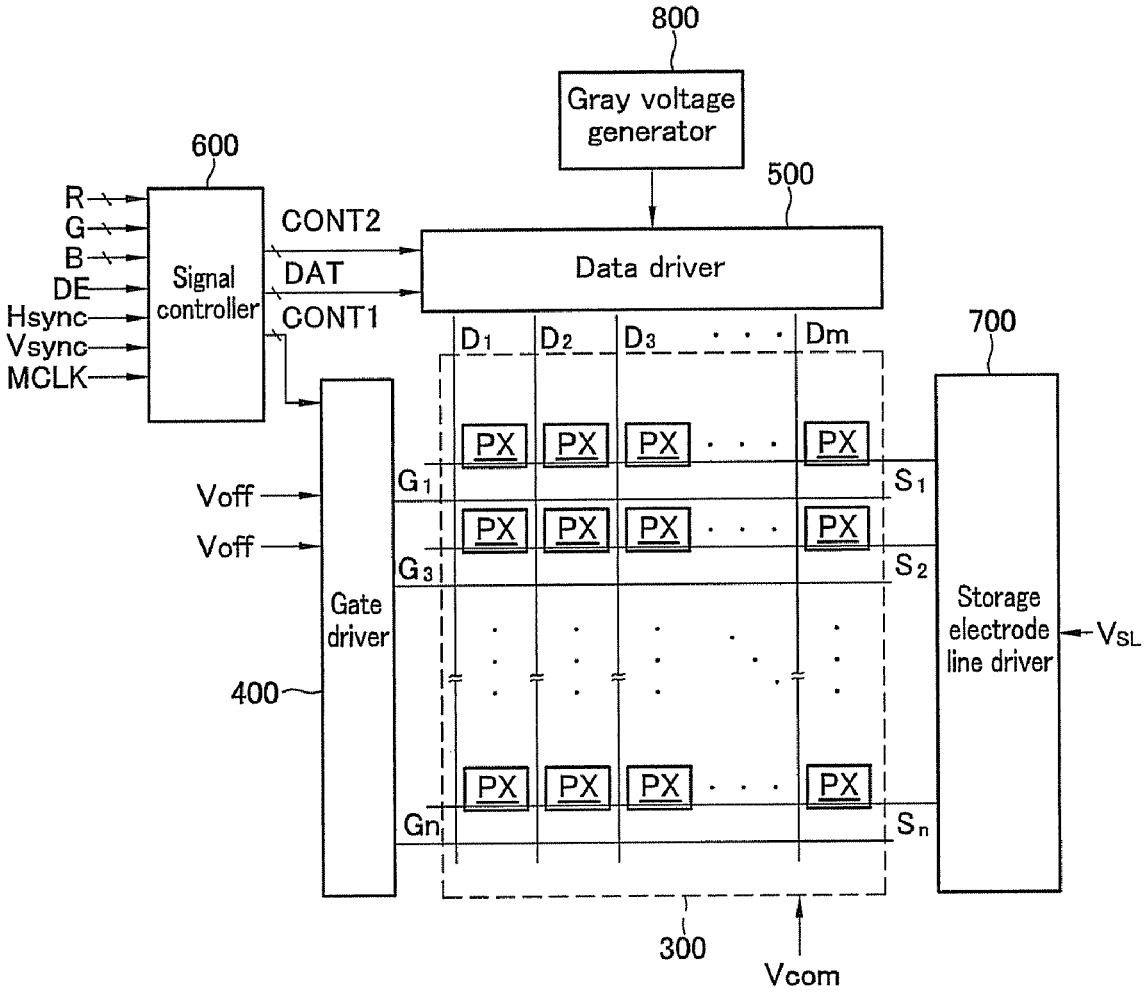
FIG. 1 is a block diagram of a liquid crystal display according to an exemplary embodiment of the present invention.

In the drawings, the thickness of layers, films, panels, regions, etc., are exaggerated for clarity. It will be understood that when an element such as a layer, film, region, or substrate is referred to as being "on" another element, it can be directly on the other element or intervening elements may also be present. In contrast, when an element is referred to as being "directly on" another element, there are no intervening elements present. A liquid crystal display according to an exemplary embodiment of the present invention will be described in detail with reference to FIGS. 1 and 2.

Figure 2:
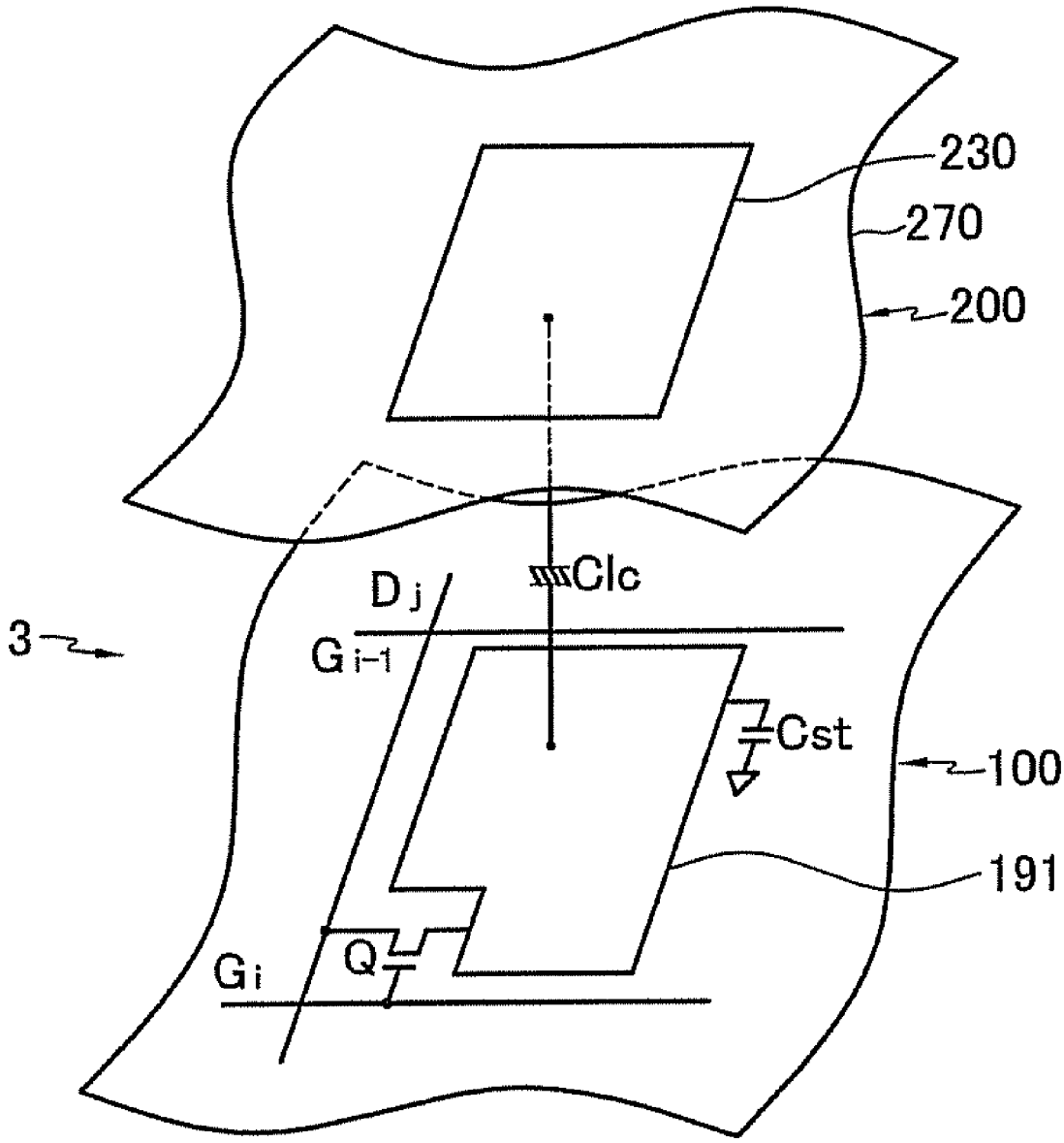
FIG. 2 is an equivalent circuit diagram of one pixel in the liquid crystal display according to an exemplary embodiment of the present invention.

FIG. 1 is a block diagram of a liquid crystal display according to an exemplary embodiment of the present invention, and FIG. 2 is an equivalent circuit diagram of one pixel in the liquid crystal display according to an exemplary embodiment of the present invention.

As shown in FIG. 1, the liquid crystal display includes a liquid crystal panel assembly 300, a gate driver 400, a data driver 500, a storage electrode driver 700, a gray voltage generator 800 connected to the data driver 500, and a signal controller 600 that controls these components.

The liquid crystal panel assembly 300 includes a plurality of signal lines $G_1$-$G_n$, $D_1$-$D_m$, and $S_1$-$S_n$, and a plurality of pixels PX connected to the signal lines $G_1$-$G_n$, $D_1$-$D_m$, and $S_1$-$S_n$ and arranged substantially in a matrix. In the structural view shown in FIG. 2, the liquid crystal panel assembly 300 includes lower and upper panels 100 and 200 facing each other and a liquid crystal layer 3 interposed between the panels 100 and 200. The signal lines include a plurality of gate lines $G_i$-$G_n$, a plurality of data lines $D_1$-$D_m$, and a plurality of storage electrode lines $S_1$-$S_n$.

The storage electrode lines $S_1$-$S_n$ are connected to the storage electrode driver and extend substantially in the same direction as the gate lines extend.

Referring to FIG. 2, each pixel PX, for example a pixel PX connected to the $i^{th}$ gate line Gi $G_i$ (i=1, 2, . . . , 2n) and the $j^{th}$ data line $D_j$ (j=1, 2, . . . , m), includes a pixel switching element Kij connected to the signal lines $G_i$ and $D_j$, and a liquid crystal capacitor Clc and a storage capacitor Cst that are connected to the pixel switching element Kij.

Pixel switching element Kij is a three terminal element such as a thin film transistor, and is disposed on the lower panel 100. Pixel switching element Kij has a control terminal connected to the gate line $G_i$, an input terminal connected to the data line $D_j$, and an output terminal connected to the liquid crystal capacitor Clc and storage capacitor Cst.

Liquid crystal capacitor Clc comprises pixel electrode 191 of the lower panel 100 and common electrode 270 of the upper panel 200 as two electrodes, and liquid crystal layer 3 interposed between the two electrodes as a dielectric. Pixel electrode 191 is connected to pixel switching element Kij. Common electrode 270 is disposed on the entire surface of the upper panel 200 and supplied with a common voltage Vcom which is a DC voltage having a predetermined value.

The common electrode 270 may be disposed on the lower panel 100.

Storage capacitor Cst is constructed by overlapping of pixel electrode 191 and storage electrode lines $S_i$ with an insulator between them.

Referring to FIG. 1, gray voltage generator 800 generates a certain number of gray voltages (referred to as "reference gray voltages" hereinafter) related to the transmittance of the pixels PX.

Gate driver 400 generates gate signals and outputs the gate signals to the gate lines. Each of the gate signals has a turn-on voltage Von and a turn-off voltage Voff.

Gate driver 400 may be integrated into the liquid crystal panel assembly 300 along with the signal lines $G_1$-$G_m$ $D_1$-$D_m$, and $S_1$-$S_n$, the switching elements Q and pixel electrodes. Alternatively, gate driver 400 may include at least one integrated circuit (IC) chip mounted on the LC panel assembly 300 or on a flexible printed circuit (FPC) film in a tape carrier package (TCP) type, which are attached to the panel assembly 300.

Signal controller 600 controls gate driver 400 and data driver 500. Signal controller 600 receives input image signals R, G, and B and input control signals from an external graphics controller (not shown). The input image signals R, G, and B contain luminance information of pixels PX. The luminance has a predetermined number of gray levels, for example 1024 ($=2^{10}$), 256 ($=2^{8}$), or 64 ($=2^{6}$) grays. The input control signals include a vertical synchronization signal Vsync, a horizontal synchronization signal Hsync, a main clock signal MCLK, and a data enable signal DE.

Signal controller 600 processes the image signals R, G, and B based on the input control signals and the input image signals R, G, and B to generate gate control signals CONT1 and data control signals CONT2, and then transmits them to corresponding drivers.

Gate control signals CONT1 include a scanning start signal STV for indicating scanning start, and at least one clock signal for controlling an output period of the turn-on voltage Von. Gate control signals CONT1 may also include an output enable signal OE for defining the duration of the turn-on voltage Von.

Data control signals CONT2 include a horizontal synchronization start signal STH for indicating data transmission for a row of pixels PX, a load signal LOAD for commanding to apply data voltages to the data lines $D_1$ to $D_m$, and a data clock signal HCLK. Data control signals CONT2 may further include an inversion signal RVS for inverting a polarity of the data voltages with respect to the common voltage Vcom.

In response to the data control signals CONT2 from signal controller 600, data driver 500 receives a packet of the digital image signals DAT for a row of the pixels PX, converts the digital image signals DAT to analog data voltages selected from the gray voltages, and applies the analog data voltages to data lines $D_1$ to $D_m$.

Gate driver 400 applies the turn-on voltage Von to gate lines $G_1$-$G_n$, line by line, in response to the gate control signals CONT1 from the signal controller 600, and turns on the switching elements Q connected to a gate line in which a turn-on voltage Von is applied.

The data voltages applied to the data lines $D_1$-$D_m$ are then supplied to the pixels PX through the turned on switching transistors Q so that the liquid crystal capacitor Clc and storage capacitor Cst in the pixels PX are charged.

Storage electrode driver 700 is connected to storage electrode lines $S_1$-$S_n$ and applies a storage voltage. The storage voltage has two levels, one of the two levels is a low level and the other is a high level.

Storage electrode driver 700 may be integrated on the liquid crystal panel assembly 300 along with the signal lines $G_1$-$G_n$, $D_1$-$D_m$, and $S_1$-$S_n$, switching elements Kij and pixel electrodes. The storage electrode driver 700 also may be an integrated circuit (IC) chip mounted on the LC panel assembly 300 or on a flexible printed circuit (FPC) film which are attached to the panel assembly 300.

Storage electrode driver 700 supplies one of high or low level voltage, as a sustaining voltage, as the turn-on voltage is being applied to a gate line Gi to a storage electrode line Si overlapped with a pixel row connected to the gate line. Meanwhile the other voltage level, as a boosting voltage, at more than two different interval during the turn-off voltage is applied to said gate line to the storage electrode line Si.

Thereby, the voltage of floated pixel electrodes 191 in the $i^{th}$ pixel row is varied in accordance with the voltage variation of the storage electrode lines. By repeating this procedure for all pixel rows, the liquid crystal display displays an image for a frame.

The data voltage is selected from one of a first voltage group and second data voltage group. Data voltages of the first data voltage group are determined so that the voltage of the pixel electrode is higher than the common voltage when the boosting voltage is applied to the storage electrode line. When the data voltage is selected from the first data voltage group, the data voltage is said to have a positive polarity.

On the other hand, data voltages of the second data voltage group are determined so that the voltage of the pixel electrode is lower than the common voltage when the boosting voltage is applied to the storage electrode line. When the data voltage is selected from the second data voltage group, the data voltage is said to have a negative polarity.

When the next frame starts, the inversion signal RVS applied to the data driver 500 is controlled such that the polarity of the data voltages is reversed (which is referred to as "frame inversion"). In addition, the polarity of the data voltages applied to pixels PX of a row is substantially the same while the polarity of the data voltages applied to pixels PX of the two adjacent rows is opposite (so called "row inversion").

Since the liquid crystal display according to an exemplary embodiment of the present invention performs frame inversion and row inversion, the polarity of all data voltages applied to pixels PX of one row is positive or negative and is changed every frame.

The storage voltage applied to storage electrode lines S1-Sn is changed from a low level voltage, as a sustaining voltage, to a high level voltage, as a boosting voltage, when pixel electrode 191 is charged by a positive polarity data voltage. In this moment, the pixel electrode is electrically floated, so that the increase of the voltage of the storage electrode increases the pixel electrode voltage by a capacitive coupling between the storage electrode and the pixel electrode.

On the other hand, the storage voltage is changed from a high level voltage, as a sustaining voltage, to a low level voltage, as a boosting voltage, when pixel electrode 191 is charged by a negative polarity data voltage. This decrease in voltage of the storage electrode decreases pixel electrode voltage by capacitive coupling.

Thereby, the voltage range of pixel electrode 191 can be wider than the range of the gray voltages that are the basis of data voltages such that the luminance range using a low basic voltage is increased.

The difference between the magnitude of a pixel electrode voltage and the common voltage Vcom applied to a pixel PX is represented as a voltage across the liquid crystal capacitor Clc of the pixel PX, which is referred to as a pixel voltage. The liquid crystal molecules in the liquid crystal capacitor Clc have orientations depending on the magnitude of the pixel voltage, and the molecular orientations determine the polarization of light passing through the liquid crystal layer 3. The polarizer(s) converts light polarization to light transmittance such that the pixel PX has a luminance represented by a gray of the data voltage.

An embodiment of the storage electrode driver according to the present invention will be explained referring to FIGS. 3 and 4.

Figure 3:
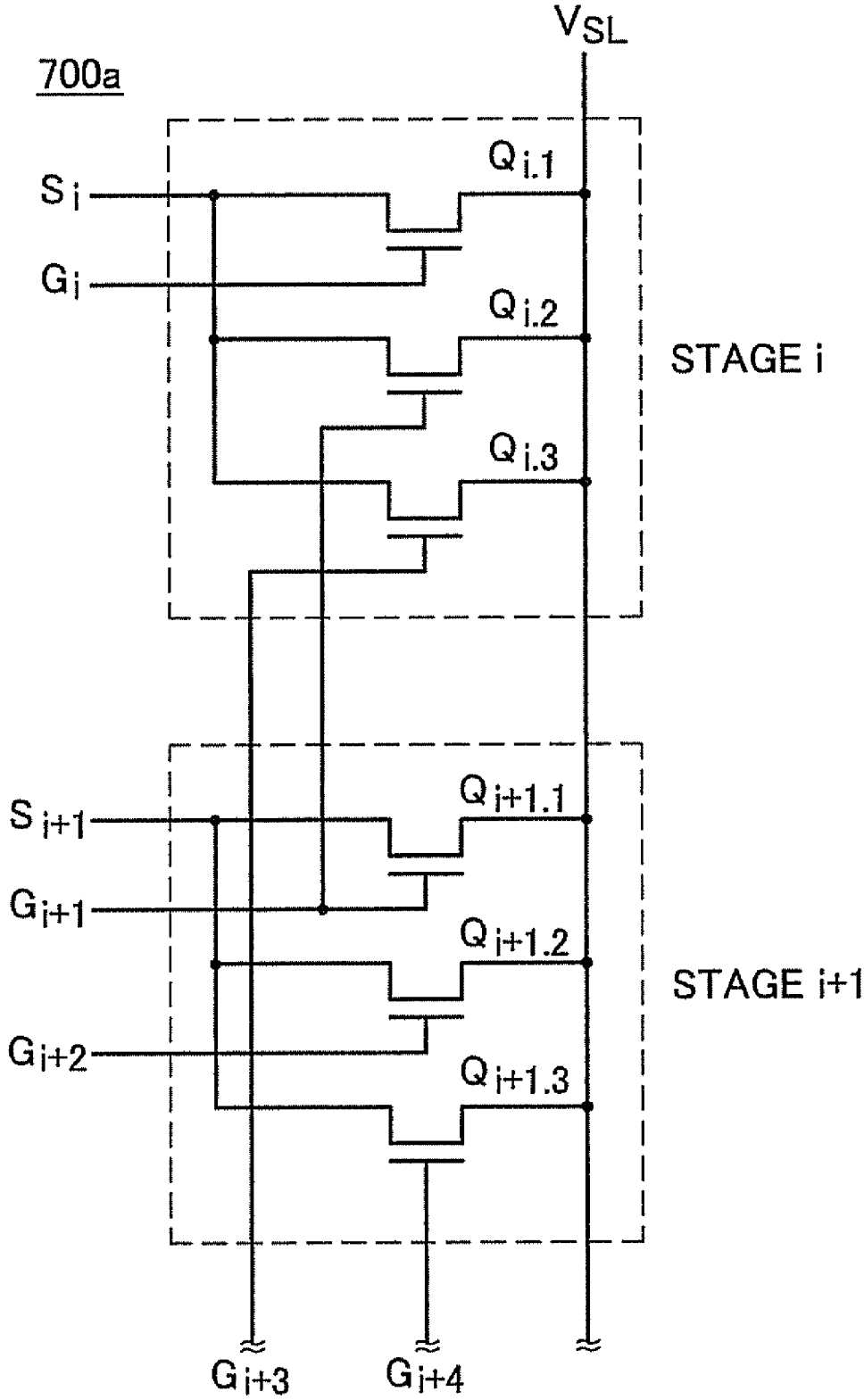
FIG. 3 is a circuit diagram of an example of a storage electrode driver according to an exemplary embodiment of the present invention.
Figure 4:
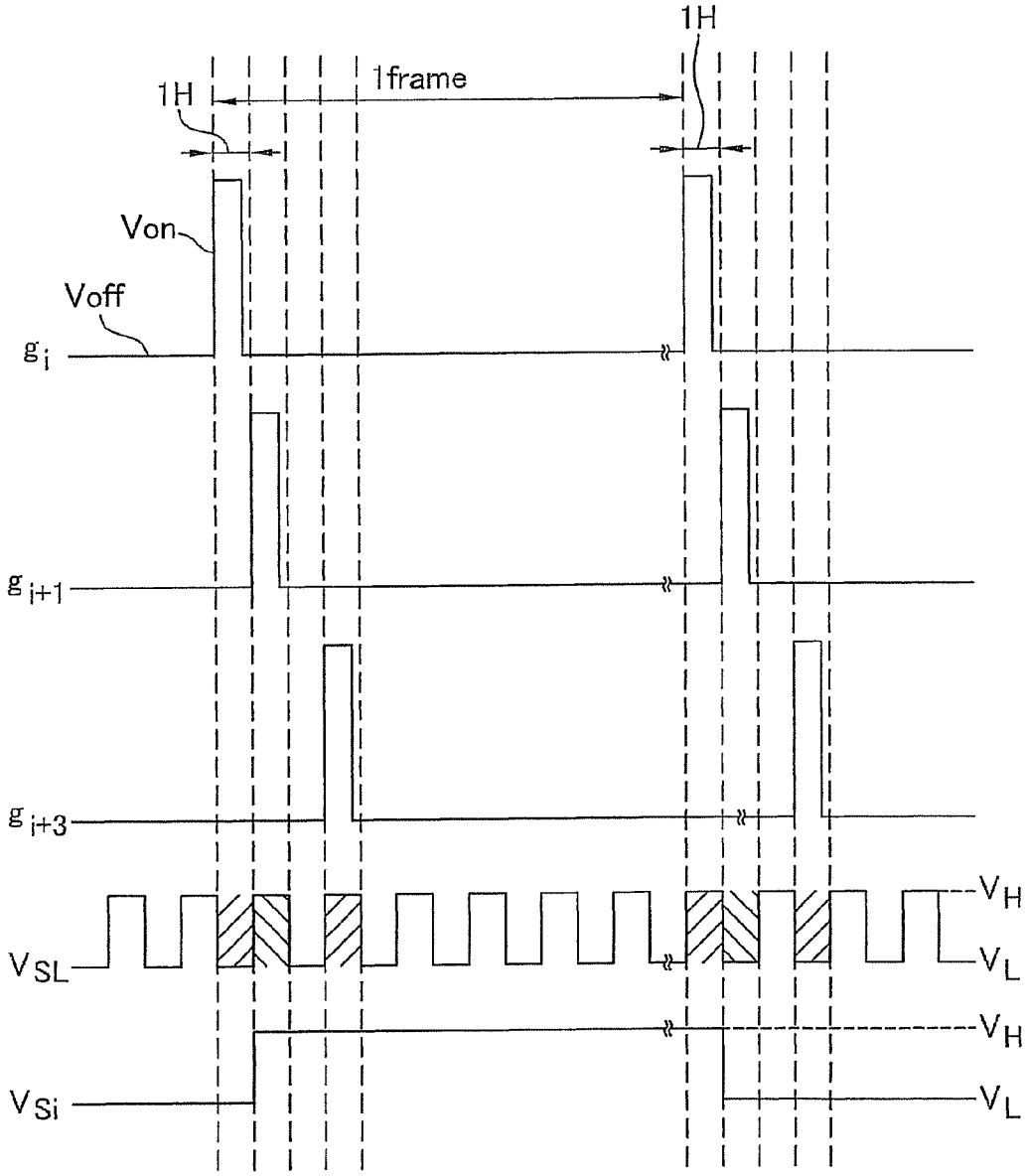
FIG. 4 is a timing diagram of signals used in the liquid crystal display including the signal generating circuit shown in FIG. 3.

FIG. 3 is a circuit diagram of a storage electrode driver according to an exemplary embodiment of the present invention, and FIG. 4 shows timing diagram signals used in a liquid crystal display including the storage electrode driver shown in FIG. 3.

A storage electrode driver has a plurality of stages, each of which is connected to a storage electrode line. The $i^{th}$ stage and the $(i+1)^{th}$ stage are depicted as STAGE_i and STAGE_i+1 respectively in FIG. 3.

Each stage includes three or more switching devices. As one of the simplest embodiment, FIG. 3 shows a stage having three transistors as switching devices.

The first transistor Qi,1 of the $i^{th}$ stage STAGE_i has a source electrode as an input terminal, a drain electrode as an output terminal and a gate electrode as a control terminal. The source electrode of the first transistor Qi,1 is connected to the storage electrode lines driving voltage source $V_{SL}$ through the storage electrode lines driving voltage supply line SL.

The drain electrode of the first transistor Qi,1 is connected to the $i^{th}$ storage electrode lines Si. The gate electrode of the first transistor Qi,1 is connected to the $i^{th}$ gate line Gi.

The second transistor Qi,2 of the $i^{th}$ stage STAGE_i has a source electrode as an input terminal, a drain electrode as an output terminal and a gate electrode as a control terminal. The source electrode of the second transistor Qi,2 is connected to the storage electrode lines driving voltage source $V_{SL}$ through the storage electrode lines driving voltage supplying line SL. The drain electrode of the second transistor Qi,2 is connected to the $i^{th}$ storage electrode lines Si. And the gate electrode of the second transistor Qi,2 is connected to the $(i+1)^{th}$ gate line Gi+1.

The third transistor Qi,3 of the $i^{th}$ stage STAGE_i has a source electrode as an input terminal, a drain electrode as an output terminal and a gate electrode as a control terminal. The source electrode of the third transistor Qi,3 is connected to the storage electrode lines driving voltage source $V_{SL}$ through the storage electrode lines driving voltage supplying line SL. The drain electrode of the third transistor Qi,3 is connected to the $i^{th}$ storage electrode lines Si. The gate electrode of the third transistor Qi,3 is connected to the $(i+3)^{th}$ gate line Gi+3.

As shown in FIG. 4, the storage driving voltage $V_{SL}$ alternates between high level voltage $V_H$ and low level voltage $V_L$. The alternating period is about 2H, and the duration of each voltage level is substantially the same, in other word about 1H for each.

Referring to FIG. 3 and FIG. 4, the polarity of data voltages applied to pixels connected to the $i^{th}$ gate line is positive when the turn-on level Von is applied to the $i^{th}$ gate line.

Simultaneously, the first transistor Qi,1 is turned on and supplies the low level $V_L$ with the storage electrode lines Si.

After about 1H elapses, voltage applied to the $i^{th}$ gate line Gi is changed to turned-off level Voff and the voltage applied to the $(i+1)^{th}$ gate line Gi+1 is changed to turn-on level Von.

At the same time, the second transistor Qi,2 is turned on by the Von of $(i+1)^{th}$ gate line and supplies the high level $V_H$ with the $i^{th}$ storage electrode lines Si.

Therefore, the voltage of the $i^{th}$ storage electrode line is changed from $V_L$ to $V_H$, which changes voltages of pixels connected to the $i^{th}$ gate line Gi by a capacitive coupling between the $i^{th}$ storage electrode line and the pixel electrodes connected to the $i^{th}$ gate line.

On the other hand, as shown in FIG. 4, the polarity of data voltage $V_D$ is changed to a negative in the next frame and the storage electrode lines driving voltage is a high level $V_H$ during the turn-on period of the $i^{th}$ gate line Gi. The storage driving voltage $V_{SL}$ is changed from $V_H$ to $V_L$ when the voltage of $(i+1)^{th}$ gate line Gi+1 changes from Voff to Von.

Equation 1 shows the relation between the pixel voltage change and the storage electrode lines voltage. Herein, Vp is pixel voltage, $V_D$ is the data voltage charged to the pixels connected to the $i^{th}$ gate line Gi during the turn-on period of the $i^{th}$ gate line Gi.

$$V_p = V_D \pm \frac{C_{st}}{C_{st} + C_{lc}}(V_H - V_L) \qquad \text{Equation 1}$$

The sign after $V_D$ is positive (+) when the data voltage has a positive polarity, and negative (−) when the data voltage has a negative polarity.

The range of data voltages $V_D$ can be selected according to the characteristics of the LC panel. As an embodiment, a data voltage $V_D$ is selected from a voltage set having a voltage range, for example having 5V for a maximum gray scale level and 0V for a minimum gray scale level, during the positive polarity period. The data voltage $V_D$ is selected from a voltage set having a reverse sequence of the voltage set for positive polarity, for example 0V for a maximum gray scale level and 5V for a minimum gray scale level, during the negative polarity period. In this case, a difference between the data voltage for a gray scale level and that for a maximum or minimum gray scale level is substantially same whichever the polarity is. In the above example, if a data voltage of $125^{th}$ gray scale level is 3V for positive polarity and 2V for negative polarity, the difference data voltage from maximum gray scale level for each polarity is the same, 2V.

Even though the gate electrode of a second transistor in the $i^{th}$ stage is connected to the next stage, (i+1)th stage, in this embodiment, the connection may be constructed differently by when the level of the storage driving voltage supplied by the second transistor is different from that supplied by the first transistor.

One possible modification is that the gate electrode of a second transistor in the $i^{th}$ stage is connected to the $(i+2K+1)^{th}$ gate line because the level of storage driving voltage applied by turning on the second TFT is different from the level of the storage driving voltage applied by turning on the first transistor.

Herein K is a natural number or zero. In the case that K is 0, the gate electrode of the second transistor is connected to the next gate line, for each stage.

The second transistor Qi,2 has a parasitic capacitance between the drain electrode and the gate electrode thereof. This parasitic capacitance induces and charges the turn-on voltage to the drain electrode while the second transistor Qi,2 is turned on these induced charges flow to the storage electrode so as to drop the pixel voltage when the second transistor Qi,2 is turned off. The quantity of the pixel voltage drop is proportional to the parasitic capacitance. Therefore it is required to reduce the parasitic capacitance for reducing the storage voltage drop.

On the other hand, the size of the second transistor needs to be large enough to drive a whole storage capacitor line, which is a limit of reducing the parasitic capacitance.

To solve this problem, the storage electrode driver of the present invention provides the storage driving voltage more than two times after charging pixels.

The third transistor Qi,3 is turned on and supplies a high level $V_H$ with the $i^{th}$ storage electrode lines once again when Von is applied to the $(i+3)^{th}$ gate line.

Therefore, the size of each transistor of the second and third transistor can be reduced because the boosting voltage supplying duration is doubled.

The liquid crystal panel may include 2N+1 additional gate lines because the second transistor of the last stage needs a next gate line to be connected and each third transistor of the last 2N+1 stages needs a $(2N+1)^{th}$ next gate line respectively.

For example, when the liquid crystal has 100 gate lines and 100 storage electrode th, lines, and N is 1, the gate electrode of the third transistor in the $98^{th}$, $99^{th}$ and $100^{th}$ stage needs a $101^{th}$, $102^{th}$ and $103^{th}$ gate line respectively to be connected to. These $101^{th}$, $102^{th}$ and $103^{th}$ gate lines are additional gate lines which sequentially shifted turn-on voltages are applied and are not connected to pixel transistors.

Instead of forming additional gate lines on the liquid crystal panel, output terminals outputting sequentially shifted turn-on signals can be connected to the gate electrode of the third transistors of the last 2N+1 stages.

Even though the embodiment disclosed above has only a third transistor, each stage may include additional transistor (s) with the storage electrode lines to supply enough charges with a storage electrode line.

In this case, the level of storage driving voltage applied by the turning-on of the additional TFT is to be same with the level of storage driving voltage applied by the turning-on of the third transistor when the additional transistor(s) must be turned on.

For example, each stage of the storage electrode driver can include a fourth transistor having a source electrode connected to the storage driving voltage source, a drain electrode connected to the storage electrode lines and a gate electrode connected to the $(i+5)^{th}$ gate line Gi+5.

Because the storage driving voltage alternates with about 2H period, the storage voltage is high level $V_H$, which is the same level as when the third transistor is turned on, when the turn-on level is applied to the $(i+5)^{th}$ gate line.

Moreover, each stage of the storage electrode driver can include a fifth transistor having a source electrode connected to the storage driving voltage source, a drain electrode connected to the storage electrode lines and a gate electrode connected to the $i+7^{th}$ gate line Gi+7, and so on.

In general, the gate electrode of the third transistor of the $i^{th}$ stage can be connected to an $(i+2N+1)^{th}$ gate line and the gate electrode of an additional transistor other than the basic three transistors Qi1, Qi,2, Qi,3 can be connected to $(i+2M+1)^{th}$ gate line, for the first embodiment described above. Herein N is a natural number larger than K and M is a natural number larger than N.

Figure 5:
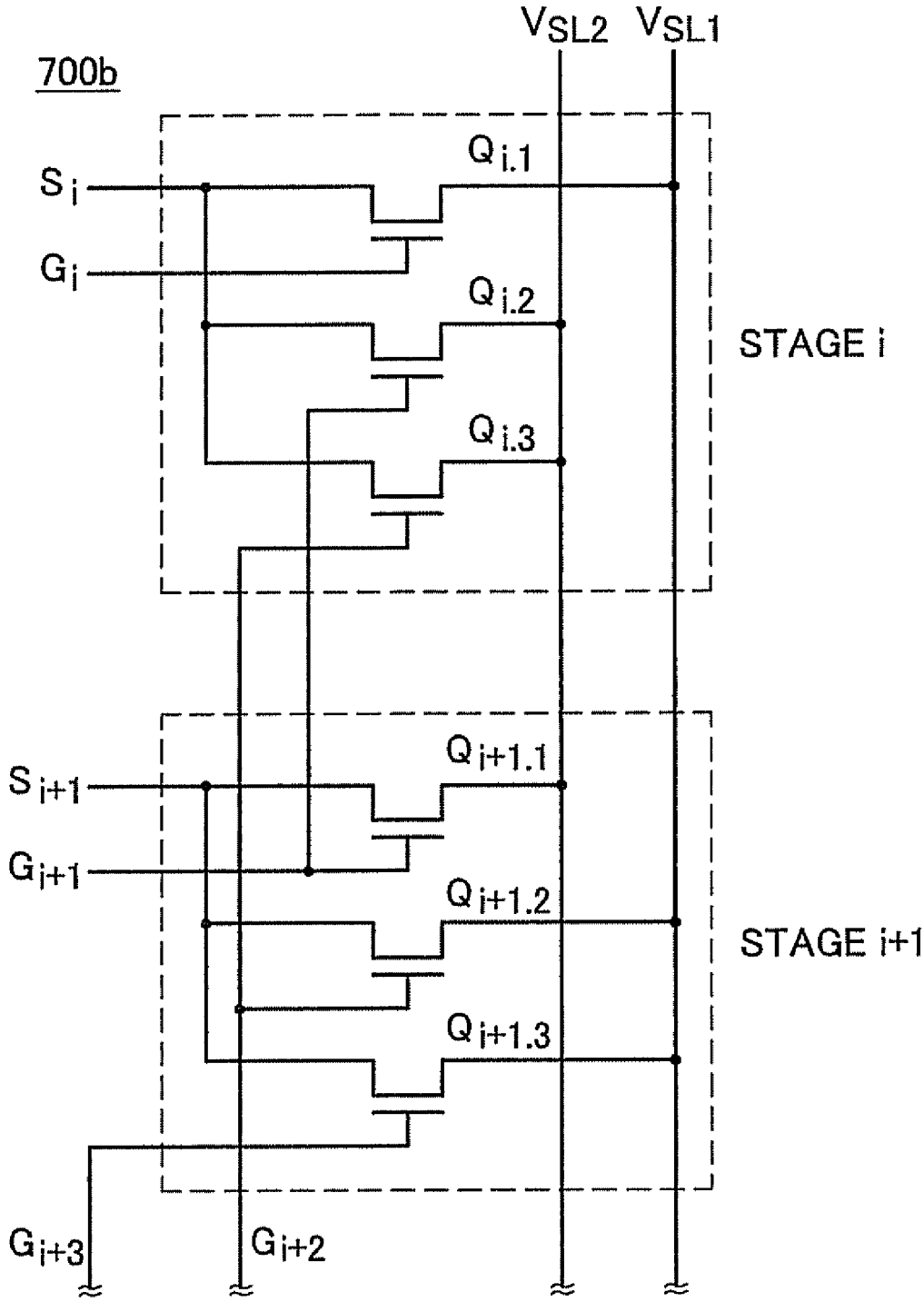
FIG. 5 is a circuit diagram of another example of a storage electrode driver according to an exemplary embodiment of the present invention.

Another embodiment of the storage electrode driver 700 according to the present invention will be explained referring to FIGS. 5 and 6.

The storage electrode line driver includes a first driving voltage source $V_{SL1}$ and a second driving voltage source $V_{SL2}$.

Figure 6:
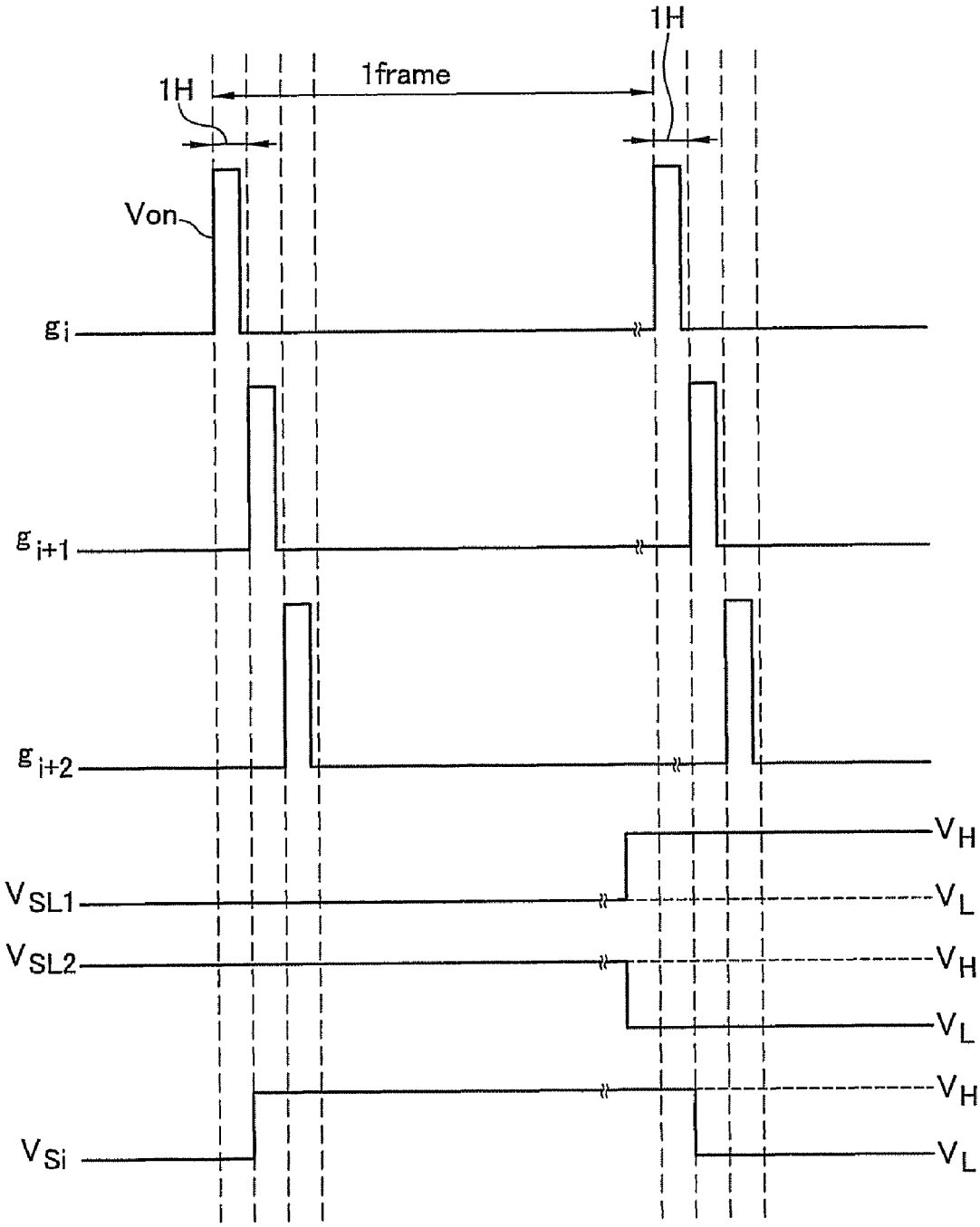
FIG. 6 is a timing diagram of signals used in the liquid crystal display including the signal generating circuit shown in FIG. 5.

As shown in FIG. 6, each of the first and second voltage source generates a driving voltage alternating between a high level and a low level with an alternating period of about 2 frames. The phases of alternating voltages generated by these two driving voltage sources are opposite to each other.

Each stage of the storage electrode driver includes three transistors and each transistor has a drain electrode connected to the same storage electrode lines.

For a stage, the source electrode of the first transistor is connected one of the first and second driving voltage sources, and the source electrodes of second and third transistors are connected to the other of the first and second driving voltage sources.

On the other hand, the source electrode of the first transistor in one of two neighboring stages is connected to one of the first and second driving voltage sources and the source electrode of the first transistor in the other stage is connected to the other driving voltage source.

The structure described above will be explained referring FIG. 5 as an example.

Each of three transistors Q'i,1, Q'i,2 and Q'i,3 of the $i^{th}$ stage is connected to the $i^{th}$ storage line.

The first transistor Q'i,1 has a gate electrode connected to the $i^{th}$ gate line and a source electrode connected to the first driving voltage source $V_{SL1}$.

The second transistor Q'i,2 has a gate electrode connected to the $(i+1)^{th}$ gate line and a source electrode connected to the second driving voltage source $V_{SL2}$.

The third transistor Q'i,3 has a gate electrode connected to the $(i+2)^{th}$ gate line and a source electrode connected to the second driving voltage source $V_{SL2}$.

Each of three transistors Q'i,1, Q'i,2 and Q'i,3 of the $(i+1)^{th}$ stage is connected to the $(i+1)^{th}$ storage line.

The first transistor Q'i+1,1 has a gate electrode connected to the $(i+1)^{th}$ gate line and a source electrode connected to the second driving voltage source $V_{SL2}$.

The second transistor Q'i+1,2 has a gate electrode connected to the $(i+2)^{th}$ gate line and a source electrode connected to the first driving voltage source $V_{SL1}$.

The third transistor Q'i+1,3 has a gate electrode connected to the $(i+3)^{th}$ gate line and a source electrode connected to the first driving voltage source $V_{SL1}$.

When the $i^{th}$ gate line is turned-on, the first transistor is turned on and supplies driving voltage generated from the first driving voltage source $V_{SL1}$, which is low level, with the $i^{th}$ storage electrode lines simultaneously.

When about 1H elapses, the $i^{th}$ gate line is turned-off, and the $(i+1)^{th}$ gate line is turned-on. Therefore, the second transistor is turned on and supplies a driving voltage generated from the second driving voltage source $V_{SL2}$, which is a high level, with the $i^{th}$ storage electrode lines.

When about 1H elapses again, the $(i+1)^{th}$ gate line is turned-off, and the $(i+2)^{th}$ gate line is turned-on. Therefore, the third transistor is turned on and supplies a driving voltage generated from the second driving voltage source $V_{SL2}$, which is the high level, with the $i^{th}$ storage electrode lines.

The mechanism of boosting the pixel voltage and sustaining the storage voltage by the second and third transistor is same as explained in the first embodiment.

Each stage may include additional transistor(s) as explained in the first embodiment.

Generally, the gate electrode of the second transistor of the $i^{th}$ stage can be connected to an $(i+K)^{th}$ gate line. The gate electrode of the third transistor of the $i^{th}$ stage can be connected to an $(i+N)^{th}$ gate line, and the gate electrode of the additional transistor other than the basic three transistors Qi1, Qi,2, Qi,3 can be connected to an $(i+M)^{th}$ gate line, for the second embodiment. Herein K is a natural number, N is a natural number larger than K and M is a natural number larger than N.

The liquid crystal panel may include N additional gate lines because each third transistor of the last N stages needs an $N^{th}$ next gate line respectively.

For example, when the liquid crystal has 100 gate lines and 100 storage electrode lines s, and N is 2, the gate electrode of the third transistor in the $99^{th}$ and $100^{th}$ stage needs a $101^{th}$ and $102^{th}$ gate line respectively to be connected to. These $101^{th}$ and $102^{th}$ gate lines are additional gate lines in which sequentially shifted turn-on voltages are applied and are not connected to pixel transistors.

Instead of forming additional gate line on the liquid crystal panel, output terminals outputting sequentially shifted turn-on signals can be connected to the gate electrode of the third transistors of the last N stages.

Figure 7:
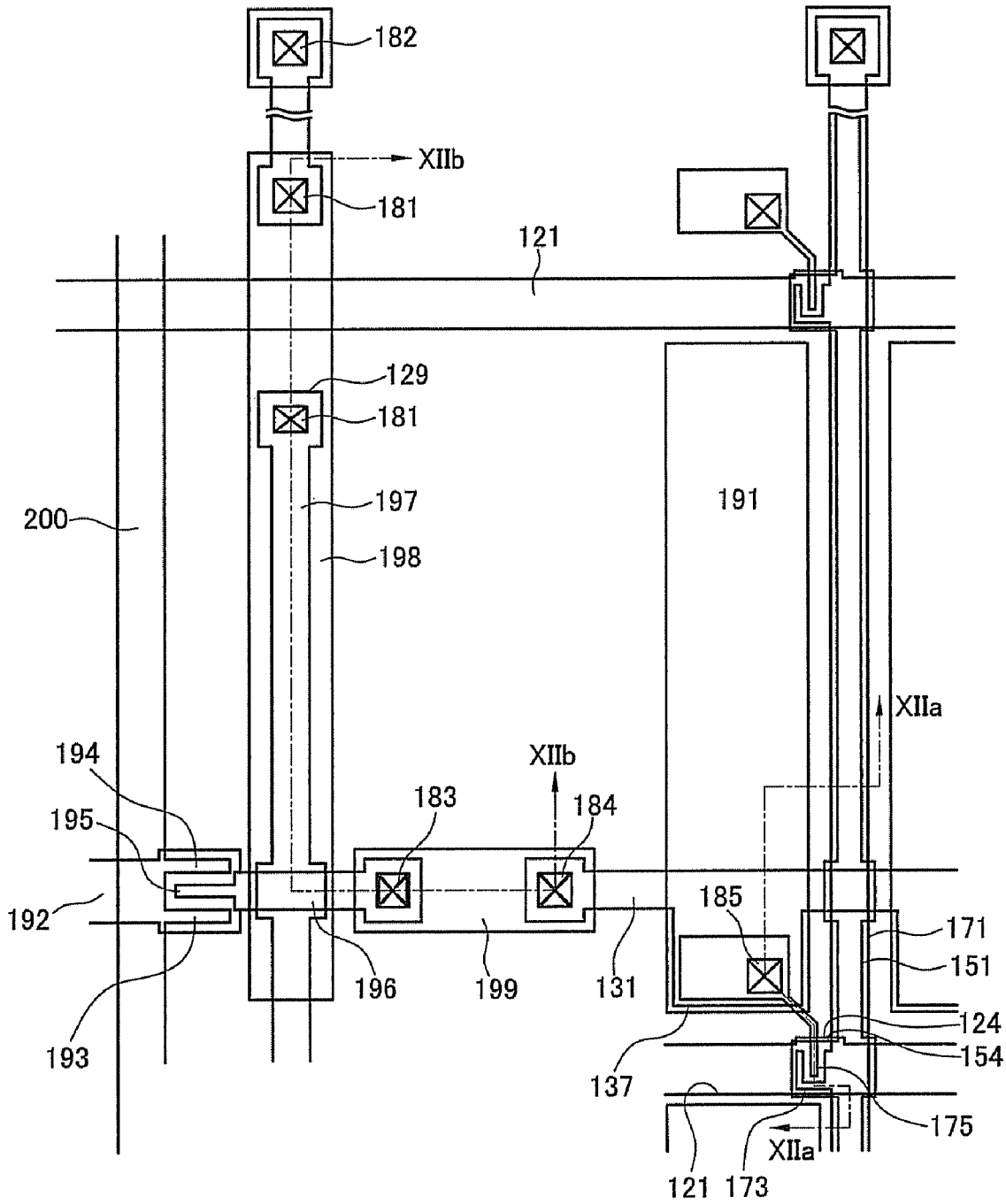
FIG. 7 is a layout view of an example of a liquid crystal display according to embodiments of the present invention.
Figure 8A:
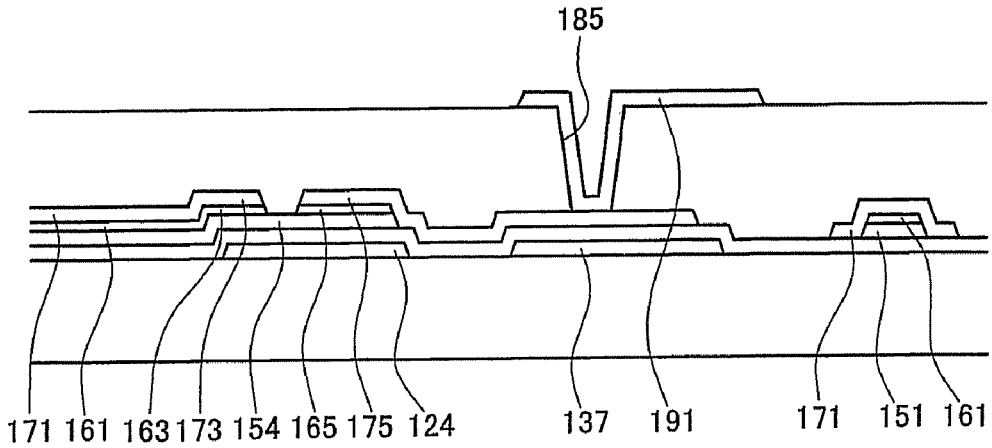
FIGS. 8A and 8B are cross-sectional views of the thin film transistor array panel taken along lines XA-XA and XB-XB of FIG. 7, respectively.
Figure 8B:
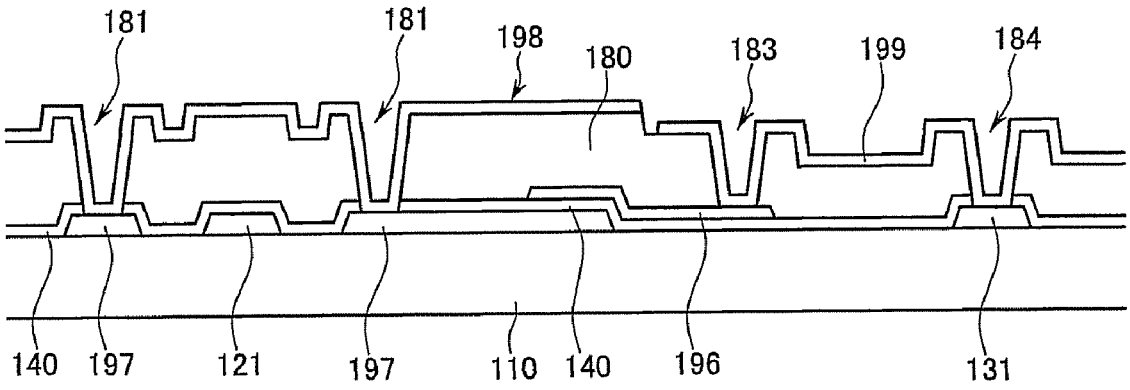

Each stage of the storage electrode driver can be formed on the liquid crystal panel. FIG. 7 is a plane view of an array on the liquid crystal panel, and FIGS. 8A and 8B are cross sectional views along XA-XA and XB-XB of FIG. 7 respectively.

A plurality of gate lines 121 and a plurality of storage electrode lines 131 and at least a first electrode line 197 are disposed on an insulating substrate 110 made of transparent glass or plastic.

Gate lines 121 include a gate electrode 124 that protrudes from gate line 121, and end portions (not shown) that have wide surface areas for connection to other layers or an external driving circuit.

Each of the storage electrode lines 131 includes a plurality of enlarged portions 137.

A first electrode line 197 primarily extends in the direction intersecting the gate line and includes a plurality of enlarged portions 197*a*.

A gate insulating layer 140 is formed on the gate lines 121, the storage electrode lines s 131 and the first electrode line 197.

A plurality of semiconductor layers 151 are formed on the gate insulating film 140.

A plurality of line-shaped and island-shaped ohmic contacts 161 and 165 are formed on the semiconductor layers 151. The ohmic contacts 161 and 165 may be made of silicide or n+ hydrogenated amorphous silicon that is heavily doped with n-type impurities such as phosphorus.

A plurality of data lines 171, a plurality of drain electrodes 175 and a plurality of storage electrode linking lines 196 are formed on the ohmic contacts 161 and 165 and the gate insulating film 140 respectively.

Each of the storage electrode linking lines 196 is connected to drain electrodes of the switching element of the storage electrode driver. At least a part of the storage electrode linking lines 196 is overlapped with the enlarged portion of the first electrode line 197.

A passivation layer 180 is formed on the substrate. Passivation layer 180 may be made of an inorganic or organic insulating material and have a planarized surface. The insulating material, there may be a silicon nitride and a silicon oxide. The organic insulating material may have photosensitivity, and the dielectric constant thereof is preferably about 4.0 or less. Alternatively, passivation layer 180 may have a double-layered structure of a lower inorganic layer and an upper organic layer in order to sustain an excellent insulating property of the organic layer and protect the exposed portions of the semiconductor layer 151.

A plurality of contact holes 182, 183 and 185 that expose end portions of data lines 171, storage electrode linking lines 196 and drain electrodes 175 and second sustaining electrode respectively, are formed on passivation layer 180. A plurality of contact holes 184 that expose storage electrode lines 131 are formed on passivation layer 180 and the gate insulating layer 140.

A plurality of pixel electrodes 191, a plurality of contact bridges and at least a second electrode 198 are formed on passivation layer 180.

Pixel electrode 191 is physically and electrically connected to drain electrode 175 through the contact hole 185, and receives a data voltage applied by drain electrode 175.

Each storage line is connected to the second electrode 198 through the contact holes 183, 184.

The second electrode 198 is connected to the first electrode 197 through the contact hole 181, and overlapped with the storage electrode linking lines 196.

A first capacitance is formed between the storage electrode linking lines 196 and the first electrode 197 and a second capacitance is formed between the storage electrode linking lines 196 and the second electrode 198. These two capacitances sustain the storage electrode voltage after the last driving voltage is applied.

While this invention has been described in connection with what is presently considered to be practical exemplary embodiments, it is to be understood by those ordinarily skilled in the art that the invention is not limited to the disclosed embodiments, but, on the contrary, is intended to cover various modifications and equivalent arrangements included within the spirit and scope of the appended claims.

What is claimed is:

1. A display apparatus comprising:

a pixel electrode;

a common electrode, provided with a common voltage;

a data driver generating a data voltage;

a gate driver generating a gate voltage;

a pixel switching device being turned on and off according to the gate voltage, and supplying the data voltage to the pixel electrode when being turned on;

a storage capacitor comprising a storage electrode overlapping a part of the pixel electrode with an insulator interposed therebetween; and a storage electrode driver supplying a boosting voltage to the storage electrode not directly connected to the pixel switching device at least two times respectively through at least two switching elements, the at least two switching elements being turned on at different times of the at least two times.

2. The display apparatus of claim 1, the storage electrode driver supplying a sustaining voltage while the pixel switching device is turned on.

3. The display apparatus of claim 2, the data voltage being selected from one of a first data voltage group and a second data voltage group.

4. The display apparatus of claim 3, a voltage of the pixel electrode is higher than the common voltage when the data voltage is selected from the first data voltage group, and the voltage of the pixel electrode is lower than the common voltage when the data voltage is selected from the second data voltage group.

5. The display apparatus of claim 4, the boosting voltage is higher than the sustaining voltage when the data voltage is selected from the first data group voltage, and the boosting voltage is lower than the sustaining voltage when the data voltage is selected from the second data group voltage.

6. The display apparatus of claim 5, the storage electrode driver further comprising a voltage source.

7. The display apparatus of claim 5, the data voltage is selected from the first and second data voltage group alternatively frame by frame.

8. The display apparatus of claim 1, wherein the storage electrode driver supplies the boosting voltage to the storage electrode for at least two durations while the pixel switching device is turned off, and each of the durations is same with the duration for which the pixel switching device is turned on.

9. The display apparatus of claim 1, the storage electrode driver further comprising a stage comprising:

a first switching element comprising an output terminal connected to the storage electrode, an input terminal connected to the voltage source and a control terminal connected to a first control signal source;

a second switching element comprising an output terminal connected to the storage electrode, an input terminal connected to the voltage source and a control terminal connected to a second control signal source; and a third switching element comprising an output terminal connected to the storage electrode, an input terminal connected to the voltage source and a control terminal connected to a third control signal source.

10. The display apparatus of claim 9, the voltage source generating a storage electrode voltage alternating between a first level and a second level higher than the first level at an alternating cycle.

11. The display apparatus of claim 10, further comprising a plurality of gate line connected to the gate driver;

the gate driver supplying each of a plurality of gate line with a turn-on voltage pulse line by line sequentially, wherein rising edges of two turn-on pulses supplied for two neighboring gate lines respectively are separated with a term;

an i_th gate line of the plurality of gate line is connected to the pixel switching device and the gate driver.

12. The display apparatus of claim 11, wherein the alternating cycle is twice the term.

13. The display apparatus of claim 12, wherein the first control signal source is the i_th gate line, the second control signal source is a i+2K+1_th gate line and the third control signal source is the i+2N+1_th gate line;

wherein the K is a natural number or 0 and the N is a natural number larger than K.

14. The display apparatus of claim 13, further comprising 2N+1 additional gate lines.

15. The display apparatus of claim 11, further comprising a storage electrode linking line, one end of the storage electrode linking line is connected to the output terminals of the first to third switching elements commonly and the other end is connected to the storage electrode.

16. The display apparatus of claim 15, further comprising a capacitance maintaining a voltage of the storage electrode.

17. The display apparatus of claim 16, the capacitance comprising:

a first capacitance comprising a part of the storage electrode linking line, a first electrode and a first insulating layer between the part of the storage electrode linking line and the first electrode; and a second capacitance comprising the part of the storage electrode linking line, a second electrode and a second insulating layer between the part of the storage electrode line and the second electrode.

18. The display apparatus of claim 17, wherein the part of the storage electrode linking line is interposed between the first and second insulating layers.

19. The display apparatus of claim 18, wherein a voltage applied to the first electrode and a voltage applied to the second electrode is same.

20. The display apparatus of claim 19, wherein the first and the second electrode are electrically connected each other.

21. The display apparatus of claim 1, wherein each of the at least two times lasts for 1 horizontal period, the 1 horizontal period being a pulse width of a turn-on voltage pulse.

* * * * *